US006112998A

United States Patent [19]

Taguchi

[11] Patent Number: 6,112,998

[45] Date of Patent: Sep. 5, 2000

[54] THERMOSTATIC EXPANSION VALVE HAVING OPERATION REDUCED WITH INFLUENCE OF PRESSURE IN A REFRIGERANT PASSAGE

[75] Inventor: Yukihiko Taguchi, Maebashi, Japan

[73] Assignee: Sanden Corporation, Gunma, Japan

[21] Appl. No.: 09/349,101

[22] Filed: Jul. 8, 1999

[30] Foreign Application Priority Data

Jul. 8, 1998 [JP] Japan ..... 10-192627

[51] Int. Cl.[7] ..... F25B 41/04

[52] U.S. Cl. ..... 236/92 B; 62/225

[58] Field of Search ..... 62/225; 236/92 B

[56] References Cited

U.S. PATENT DOCUMENTS

| | | | |
|---|---|---|---|
| 3,699,778 | 10/1972 | Orth | 62/225 |
| 4,330,999 | 5/1982 | Nakayama . | |
| 4,344,566 | 8/1982 | Gotzenberger | 62/225 |
| 4,372,486 | 2/1983 | Tomioka et al. | 236/92 B |
| 4,505,122 | 3/1985 | Inomata . | |
| 4,840,039 | 6/1989 | Kazuhiko . | |
| 4,882,909 | 11/1989 | Terauchi . | |
| 4,905,477 | 3/1990 | Kazuhiko . | |
| 5,025,636 | 6/1991 | Terauchi . | |
| 5,027,612 | 7/1991 | Terauchi . | |
| 5,127,237 | 7/1992 | Sendo et al. | 62/225 |
| 5,168,716 | 12/1992 | Terauchi . | |
| 5,189,886 | 3/1993 | Terauchi . | |
| 5,547,126 | 8/1996 | Bograd, IV et al. | 236/92 B |
| 5,688,111 | 11/1997 | Takai . | |
| 5,873,706 | 2/1999 | Kawabata . | |

FOREIGN PATENT DOCUMENTS 0704622 4/1996 European Pat. Off. .

*Primary Examiner*—William E. Tapolcai
*Attorney, Agent, or Firm*—Baker Botts L.L.P.

[57] ABSTRACT

In a thermostatic expansion valve included in a refrigeration cycle for expansion of a refrigerant which is contained in the refrigeration cycle, the thermostatic expansion valve is provided with a particular chamber (14) which is substantially separated from a refrigerant passage (10, 11) for guiding the refrigerant and is connected to the refrigerant passage through an additional passage (15). The particular chamber has pressure relating to pressure in the refrigerant passage when the refrigeration cycle is operated. In order to reduce influence of the pressure in the refrigerant passage, a pressure transmission member (22) transmits the pressure in the particular chamber to a valve mechanism (200*a*, 201) which is placed in the refrigerant passage to adjust a flow of the refrigerant in the refrigerant passage. An operation control arrangement (205, 206, 207) controls an operation of the valve mechanism in response to temperature of the refrigerant.

15 Claims, 6 Drawing Sheets

EARLIER TECHNOLOGY

EARLIER TECHNOLOGY

EARLIER TECHNOLOGY

THERMOSTATIC EXPANSION VALVE HAVING OPERATION REDUCED WITH INFLUENCE OF PRESSURE IN A REFRIGERANT PASSAGE

BACKGROUND OF THE INVENTION

The present invention relates to a refrigeration cycle used in an air conditioning apparatus for vehicles and, in particular, to a thermostatic expansion valve included in the refrigeration cycle.

Such a thermostatic expansion valve in an earlier technology is shown in FIG. 4. The thermostatic expansion valve includes an expansion valve unit 2 and a closing member 3 which are contained in a valve casing 1. More specifically, in a casing 1 there are provided a high-pressure chamber 10 and a low-pressure chamber 11 which serve as a refrigerant passage directing to a evaporator 4 for a high pressure refrigerant which is discharged from a compressor discharging chamber, low pressure passages 12 which serve as a passage directing to a compressor suction chamber for a low pressure refrigerant which is discharged from the evaporator 4, and a valve unit insertion portion 13 which is disposed between the low pressure passages 12. The closing member 3 is located at an upper portion of the valve unit insertion portion 13 such that an end of the expansion valve 2 is adaptable by the use of engagement member.

The expansion valve unit 2 has a valve seat 200*a* which is located to form a port 200*b* in the high-pressure chamber 10 of the casing 1, a valve casing 200 disposed at a center of the casing 1 to close a passage between the low-pressure chamber 11 and the valve unit insertion portion 13, a valve body 201 which is contacted with and spaced from the valve seat 200*a* to open/close a passage directing to the evaporator 4 through the valve seat 200*a*, the port 200*b* and the low-pressure chamber 11, a spring 203 for biasing the valve body 201 toward a valve-closing direction (an upward direction in the illustration of FIG. 4) through a guide member 202, and an adjustment screw 204 for adjusting a pressing force of the spring 203. Further, there is disposed a temperature sensing portion 205 which is disposed in the valve unit insertion portion 13 of the casing 1 such that an end portion of the temperature sensing portion 205 is mounted to the closing member 3 and which is disposed in the midst of the low pressure passage 12 directing from the outlet portion of the evaporator 4 to the suction chamber of the compressor and, in addition, a diaphragm 206 which is displaced in accordance with pressure difference between the inner pressure of the temperature sensing portion 205 and the pressure of the outlet of the evaporator 4, a transmission rod 207 which is displaceably supported to the valve casing 200 such that one end thereof is contacted with the diaphragm 206 and the other end is provided with the valve body 201 so that the valve body 201 is opened/closed in accordance with the displacement of the diaphragm 206, and a spring 208 for urging the transmission rod 207 toward the diaphragm 206.

The expansion valve unit 2 has a passage 200*c* at the valve casing 200 so that the diaphragm 206 receives, or effected by, the pressure from the evaporator 4 by the passage 200*c*.

Within the temperature sensing portion 205 which is exposed to the refrigerant from the outlet of the evaporator 4, a refrigerant (R134*a*) and an adsorbent (oil) is sealed therein, and the pressure in the temperature sensing portion 205 is set to be varied in accordance with the temperature of the refrigerant from the outlet of the evaporator 4.

By the structure described above, there is relationship as indicated below:

$$Fd=(Pd-Pe)\cdot Sd-(Pout-Pe)\cdot Sr-f1\ ,$$

and $$Fb=f2+(Pin-Pout)\cdot Sb$$

wherein:

Fd is a pressing force for urging the diaphragm 206 toward the valve body 201;

Fb is a force effected in the valve-closing direction of the valve body 201;

Pd is a pressure in the temperature-sensing portion 205;

Pe is a pressure at the outlet of the evaporator 4;

Pin is a pressure at the inlet of the expansion valve;

Pout is a pressure at the outlet of the expansion valve;

f1 is a force of the spring 208;

f2 is a force of the spring 203;

Sd is an effective area of the diaphragm 206;

Sb is a sealing area of the valve body 201;

Sr is a sectional area of the transmission rod 207.

As a consequence, the valve body is set to be opened in case that the condition Fd>Fb is satisfied.

FIG. 5 is a graph which shows the "temperature (° C.)—pressure (kg/cm$^2$G)" characteristics under the inlet pressure conditions of the thermostatic expansion valve.

In FIG. 5, the characteristic C1 with respect to the expansion valve represents a linear line which shows that a pressure proportionally increases as the elevation of the temperature, whereas the characteristic C2 with respect to the refrigerant (R134*a*) represents a curve which shows that a pressure gradually varies and increases as the elevation of the temperature. As seen from FIG. 5, it is prescribed that the characteristic Cl extends across the characteristic C2.

Namely, in comparison between characteristic C1 and characteristic C2, if temperatures are compared with reference to pressure elevation up to 2.0 kg/cm$^2$G, the temperature of characteristic C1 represents 0° C. whereas the temperature of characteristic C2 represents a temperature value slightly higher than 0° C. However, if temperatures are then compared with reference to pressure elevation up to 2.7 kg/cm$^2$G, the temperature of characteristic C1 represents 10° C. whereas the temperature of characteristic C2 represents a temperature value lower than 10° C. by ΔT. Thus, a relationship of the temperatures relative to the pressure is reversed at a temperature above 0° C. and around 1.2° C. to form a break-even or cross-over point. This is aimed to obtain restriction of hunting of an expansion valve especially at a low and middle temperature range and returning of the refrigerant (including an oil) to the compressor, because the compressor is in a continuous operation to a low outdoor temperature range and a circulation amount of the refrigerant is extremely reduced in this region.

FIG. 6 shows the "pressure of the expansion valve inlet (kg/cm$^2$G)—static heating degree (K)" characteristics under the condition that temperature of the temperature sensing portion 205 of the thermostatic expansive valve is made constant.

In FIG. 6, the static heating degree increases as elevation of the pressure of the expansion valve inlet. This will further show that an expansion valve inlet pressure is effected in the valve closing direction of the valve body 201, and as elevation of the expansion valve inlet pressure, a force Fb effecting towards the valve body 201 is increased and, therefore, a force Fd which effects the diaphragm 206 (that is, a pressure Pb in the temperature sensing portion 205) is required to be increased for the increase of force Fd, and that the valve body 201 can be opened by satisfying these conditions described above.

In the thermostatic expansion valve described above, the valve body has operation strongly received with influence of pressure in the refrigerant passage. It is assumed as a particular case that the valve body is not opened unless the pressure in the temperature sensing portion is increased. In the particular case, there is a problem that an appropriate operational condition is not maintained.

SUMMARY OF THE INVENTION

It is therefore an object of the present invention to provide a thermostatic expansion valve which has operation reduced with influence of pressure in a refrigerant passage.

It is another object of the present invention to provide a thermostatic expansion valve of the type described, which can always maintain an appropriate operational mode regardless of the conditions of the pressure in the refrigerant passage.

Other objects of the present invention will become clear as the description proceeds.

According to the present invention, there is provided a thermostatic expansion valve included in a refrigeration cycle for expansion of a refrigerant which is contained in the refrigeration cycle. The thermostatic expansion valve includes a refrigerant passage for guiding the refrigerant, a valve mechanism placed in the refrigerant passage for adjusting a flow of the refrigerant in the refrigerant passage, and operation control means for controlling an operation of the valve mechanism in response to temperature of the refrigerant. The refrigerant passage having specific pressure when the refrigeration cycle is operated. The thermostatic expansion valve further comprises a particular chamber substantially separated from the refrigerant passage, an additional passage connected between the particular chamber and the refrigerant passage for introducing the specific pressure into the particular chamber to make the particular chamber have particular pressure relating to the specific pressure, and a pressure transmission member coupled to the particular chamber and the valve mechanism for transmitting the particular pressure to the valve mechanism to reduce influence of the specific pressure to the operation of the valve mechanism.

DESCRIPTION OF THE PREFERRED EMBODIMENT

Figure 1:
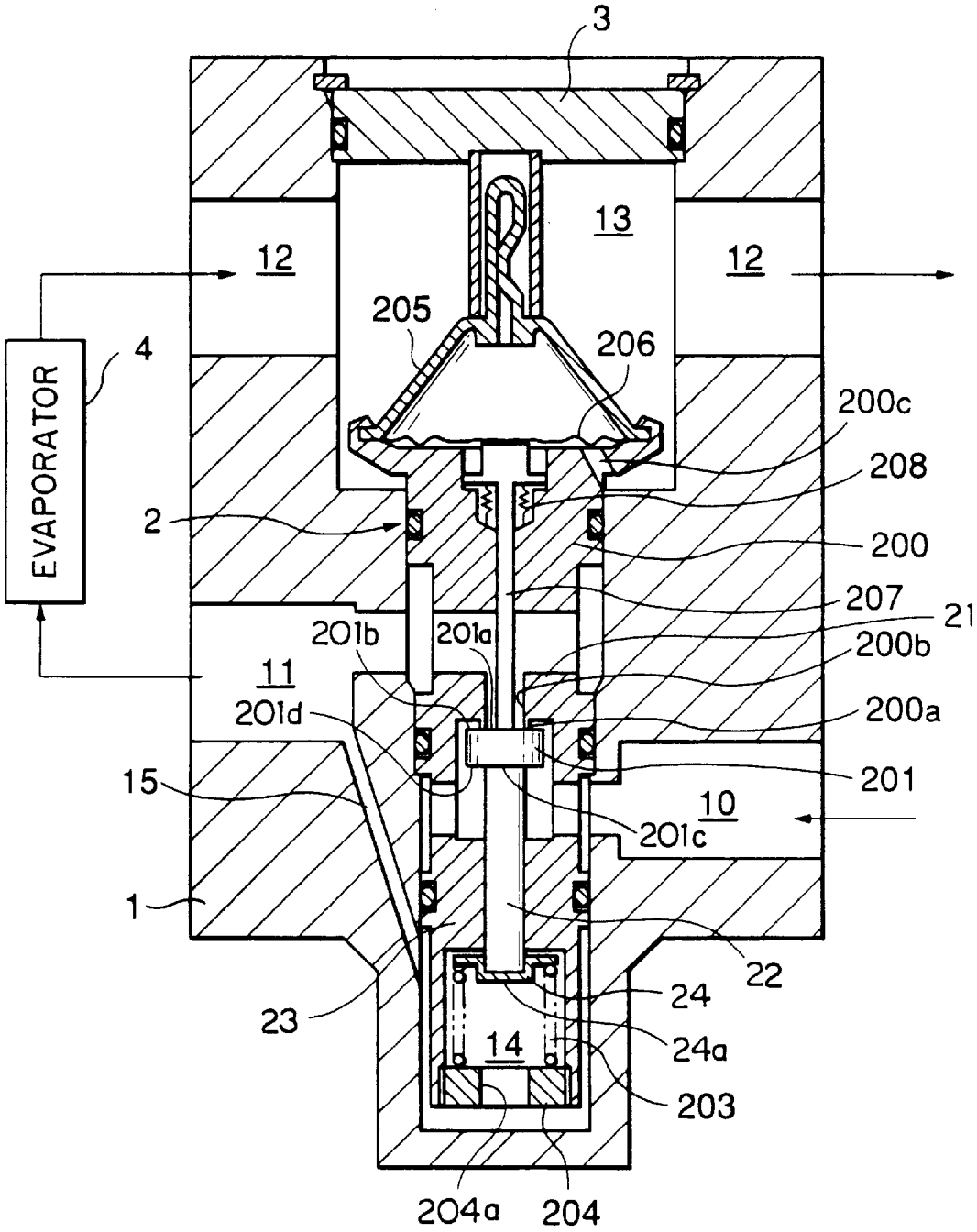
FIG. 1 is a sectional elevation of a thermostatic expansion valve according to a first embodiment of the invention, showing a basic structure thereof.

With reference to FIG. 1, description will be made as regards a thermostatic expansion valve according to a first embodiment of the present invention. The thermostatic expansion valve comprises similar parts designated by like reference numerals.

The thermostatic expansion valve is included in a refrigeration cycle for expansion of a refrigerant which is contained in the refrigeration cycle. In the thermostatic expansion valve, the expansion valve unit 2 is formed at lower portion thereof with a particular chamber 14 substantially separated from both of the high-pressure chamber 10 and the low-pressure chamber 11 that are collectively called the refrigerant passage. The high-pressure chamber 10 will be referred to as a first chamber which has an inlet pressure relatively higher when the refrigeration cycle is operated. The low-pressure chamber 11 will be referred to as a second chamber which has a specific pressure lower than the inlet pressure when the refrigeration cycle is operated.

The valve casing 1 has an additional passage 15 communicating the low-pressure chamber 10 with the particular chamber 14 through a through hole 204*a* of the adjustment screw 204. The additional passage 15 is for introducing the specific pressure into the particular chamber 14. As a result of being introduced with the specific pressure, the particular chamber 14 has particular pressure relating to the specific pressure.

The expansion valve unit 2 has a first partitioning wall 21 formed between the high and the low-pressure chambers 10 and 11. The valve seat 200*a* is formed on the first partitioning wall 21 to project in the high-pressure chamber 10. A combination of the first partitioning wall 21 and the valve seat 200*a* defines the port 200*b* connecting the high-pressure chamber 10 with the low-pressure chamber 11.

The valve body 201 faces the valve seat 200*a* and is movable in a first or downward direction and a second or upward direction. In the manner which will presently be described, the valve body 201 has an upper and a lower surface which are flat and opposite to each other in the first and the second directions. A combination of the valve seat 200*a* and the valve body 201 is referred to as a valve mechanism for adjusting a flow of the refrigerant from the high-pressure chamber 10 to the low-pressure chamber 11.

The upper surface of the valve body 201 has an upper central area 201*a* and an upper peripheral area 201*b* around the upper central area 201*a*. In a condition where the valve body 201 is in contact with the valve seat 200*a*, the upper central area 201*a* faces the port 200*b* and will be referred to as a specific-pressure receiving area for receiving the specific pressure in the first direction. The upper peripheral area 201*b* faces an area outside the valve seat 200*a* and receives the inlet pressure in the first direction when the refrigeration cycle is operated. The upper peripheral area 201*b* will be referred to as a first area.

The lower surface of the valve body 201 has a lower central area 201*c* and a lower peripheral area 201*d* around the lower central area 201*c*. The lower central area 201*c* is coupled to a pressure transmission member 22 which will presently be described. The lower peripheral area 201*d* receives the inlet pressure in the second direction when the refrigeration cycle is operated. The lower peripheral area 201*d* is determined substantially equal to the upper peripheral area 201*b*. Therefore, the valve body 201 is cancelled with influence of the inlet pressure between the first and the second directions. The lower peripheral area 201*d* will be referred to as a second area.

The pressure transmission member 22 downwardly extends from the lower central area 201*c* to the particular chamber 14 through a second partitioning wall 23. The pressure transmission member 22 is movable in the first and the second directions and is provided with a guide 24 at a lower end thereof. The spring 203 is interposed between the guide 24 and the adjustment screw 204.

The guide 24 has a central portion 24*a* and a flange portion 24*b* around the central portion 24*a*. When the refrigeration cycle is operated, the flange portion 24*b* receives the particular pressure in both of the first and the second directions and therefore is cancelled with influence of the particular pressure. The central portion 24*a* receives the particular pressure only in the second direction when the refrigeration cycle is operated. The central portion 24*a* will be referred to as a particular-pressure receiving area.

The particular pressure is transmitted from the central portion 24*a* to the valve body 201 through the pressure transmission member 22. Therefore, the valve body 201 is cancelled or reduced with influence of the specific pressure by the particular pressure. It is preferable that the central portion 24*a* has an area substantially equal to the upper central area 201*a*. The area of the central portion 24*a* may be slightly smaller than the upper central area 201*a* of the valve body 201.

With the above-mentioned arrangement, the valve body 201 is contacted reliably with the valve seat 200*a* even when there is more or less an axial gap or discrepancy relative to a supporting portion of the casing 1 in such a state that the valve body 201 is movably supported to the valve casing 200. Since a gap between the valve body 201 and a supporting portion of the casing 1 is set to be minimum, there is less danger of gas leakage from the high-pressure chamber 10 to the pressure chamber 14 and there will be no ill influence on the expansion valve.

A refrigerant (R134*a*) and an adsorbent (oil) are sealed in a temperature sensing portion 205 which is exposed to the refrigerant from an outlet of the evaporator 4. The pressure in the temperature sensing portion 205 is set to vary according to the temperature of the refrigerant from the outlet of the evaporator 4.

By the structure described above, there is relationship as indicated below:

$$Fd=(Pd-Pe)\cdot Sd-(Pout-Pe)\cdot Sr-f1$$

and $$Fb=f2$$

wherein:

Fd is a pressing force for urging the diaphragm 206 toward the valve body 201;

Fb is a force effected in the valve-closing direction of the valve body 201;

Pd is a pressure in the temperature sensing portion 205;

Pe is a pressure at the outlet of the evaporator 4;

Pin is a pressure at the inlet of the expansion valve;

Pout is a pressure at the outlet of the expansion valve;

f1 is a force of the spring 208;

f2 is a force of the spring 203;

Sd is an effective area of the diaphragm 206;

Sb is a sealing area of the valve body 201;

Sr is a sectional area of the transmission rod 207.

As a consequence, the valve body is set to be opened in case that the condition Fd>Fb is satisfied, and yet, since the force Fb is only a pressing force of the spring 203 and nothing else, a superheat characteristic which is not effected by the inlet pressure.

Figure 2:
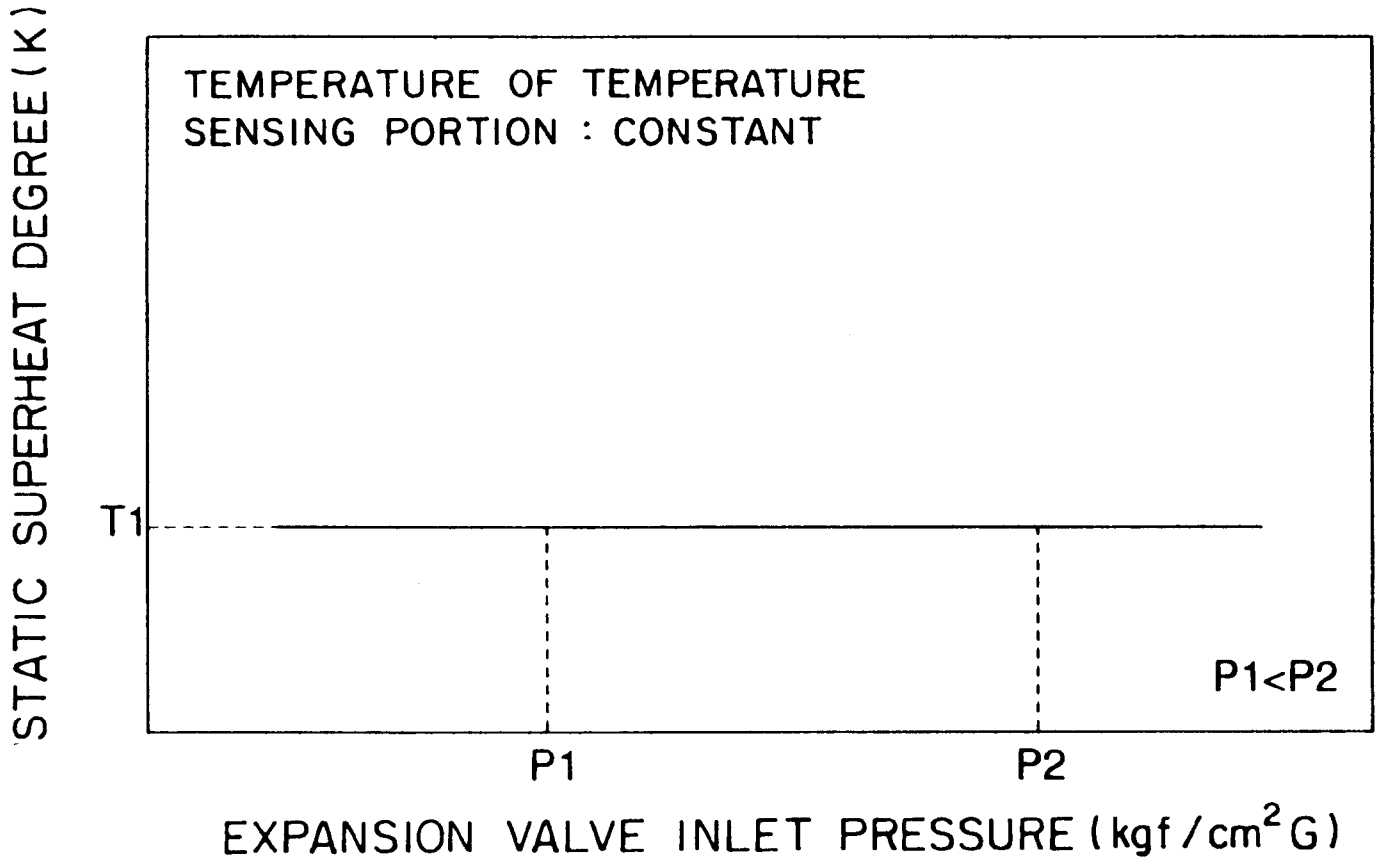
FIG. 2 is a diagram showing a characteristic of "an expansion valve inlet pressure—static superheat degree" under the condition that a temperature sensing portion of the thermostatic expansion valve is set to be constant.

FIG. 2 illustrates a graph which shows the "expansion valve inlet pressure (kg/cm$^2$G)—static (resting) superheat degree" characteristics under the condition that temperature of the temperature sensing portion 205 of the thermostatic expansion valve 205 is set to be constant.

It will be appreciated from FIG. 2 that a static superheat degree is constant regardless of the pressure at the expansion valve inlet and the super heat degree obtained is not influenced by the pressure at the expansion valve inlet. This means that, in the thermostatic expansion valve, the static superheat degree is unchanged even when the inlet pressure which effects in the valve-closing direction of the valve body 201 is elevated as it is shifted from, for example, P1 to P2 (in which P1<P2) and, therefore, a force Fb acting on the valve body 201 in the valve-closing direction is unchanged if the temperature is constant, and that the valve body 201 can be opened, without forcibly changing a force Fd which acts on the diaphragm 206 (that is, a pressure Pb in the temperature sensing portion 205).

Figure 3:
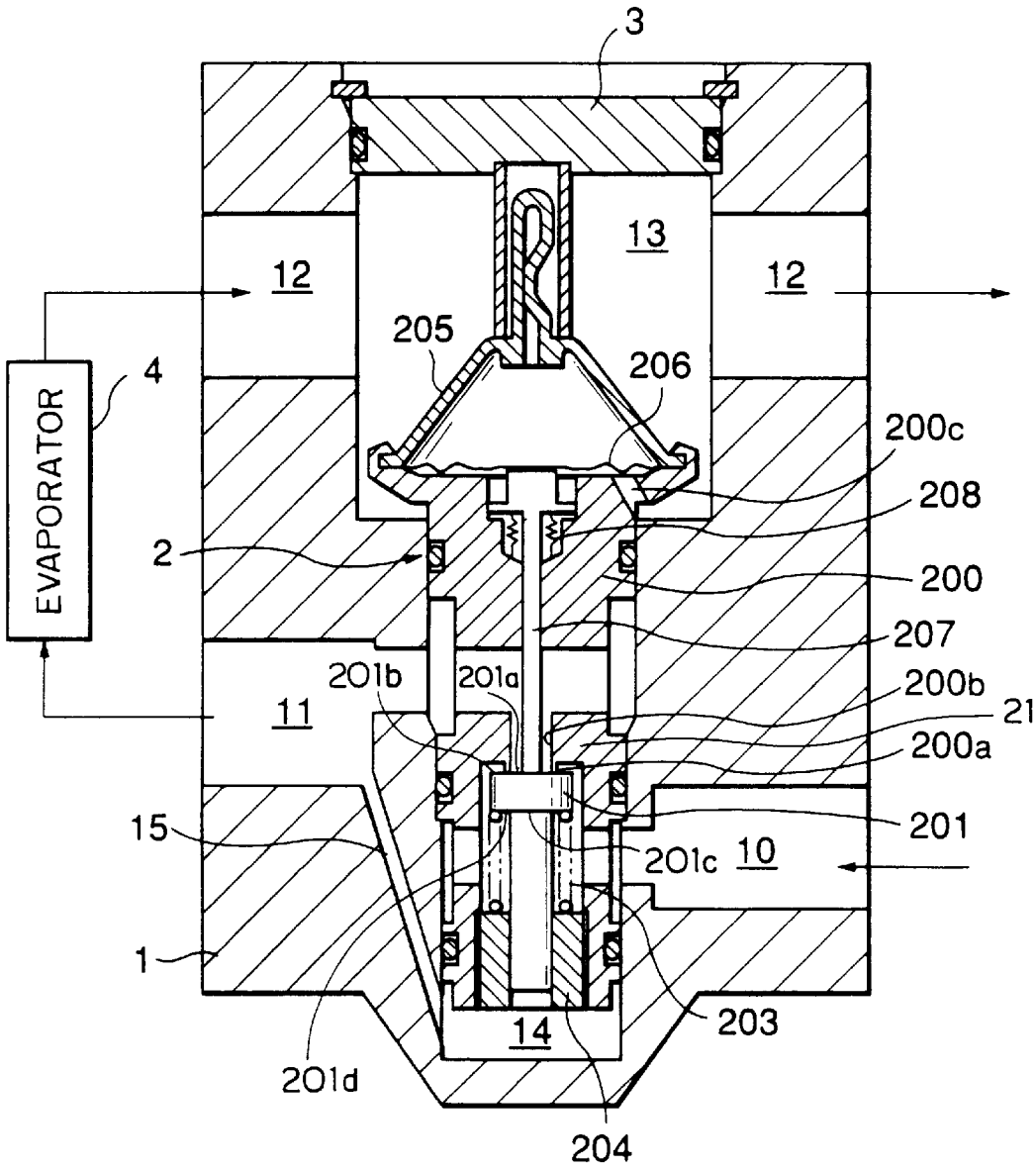
FIG. 3 is a sectional elevation of a thermostatic expansion valve according to a second embodiment of the invention.
Figure 4:
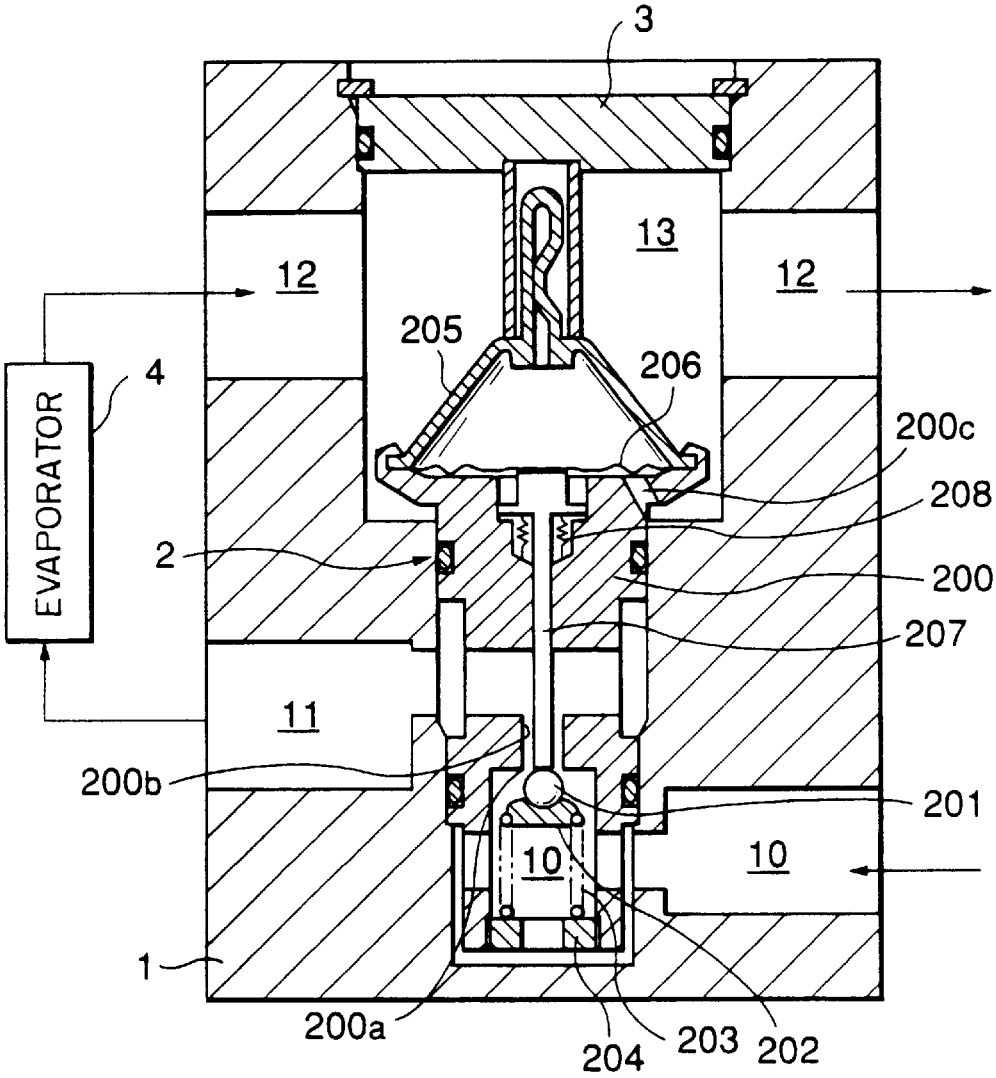
FIG. 4 is a sectional elevation of a basic structure of a thermostatic expansion valve according to an earlier technology.
Figure 5:
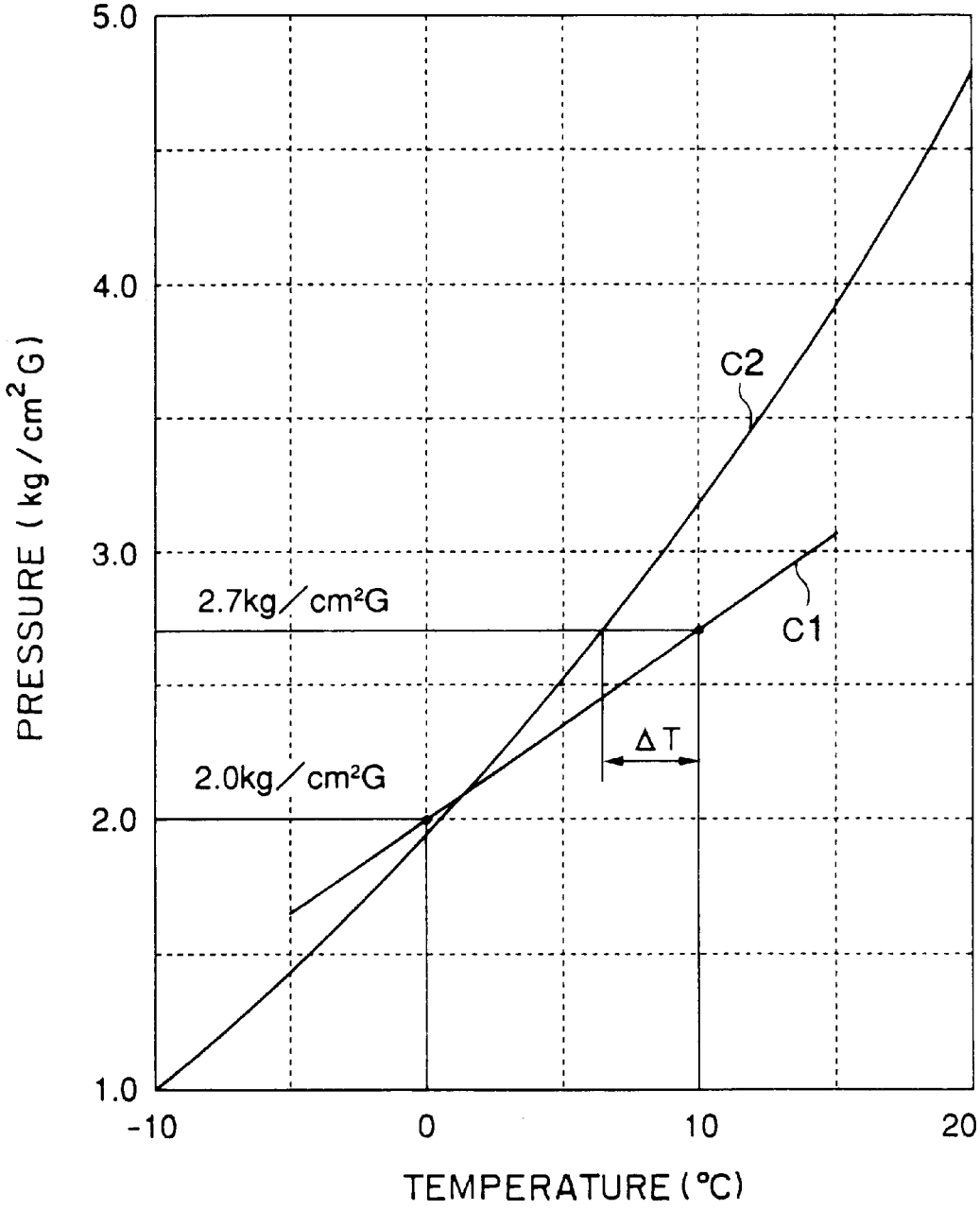
FIG. 5 is a diagram showing a characteristic of "an expansion valve inlet pressure—static superheat degree" under a predetermined inlet pressure condition of the thermostatic expansion valve shown in FIG. 4.
Figure 6:
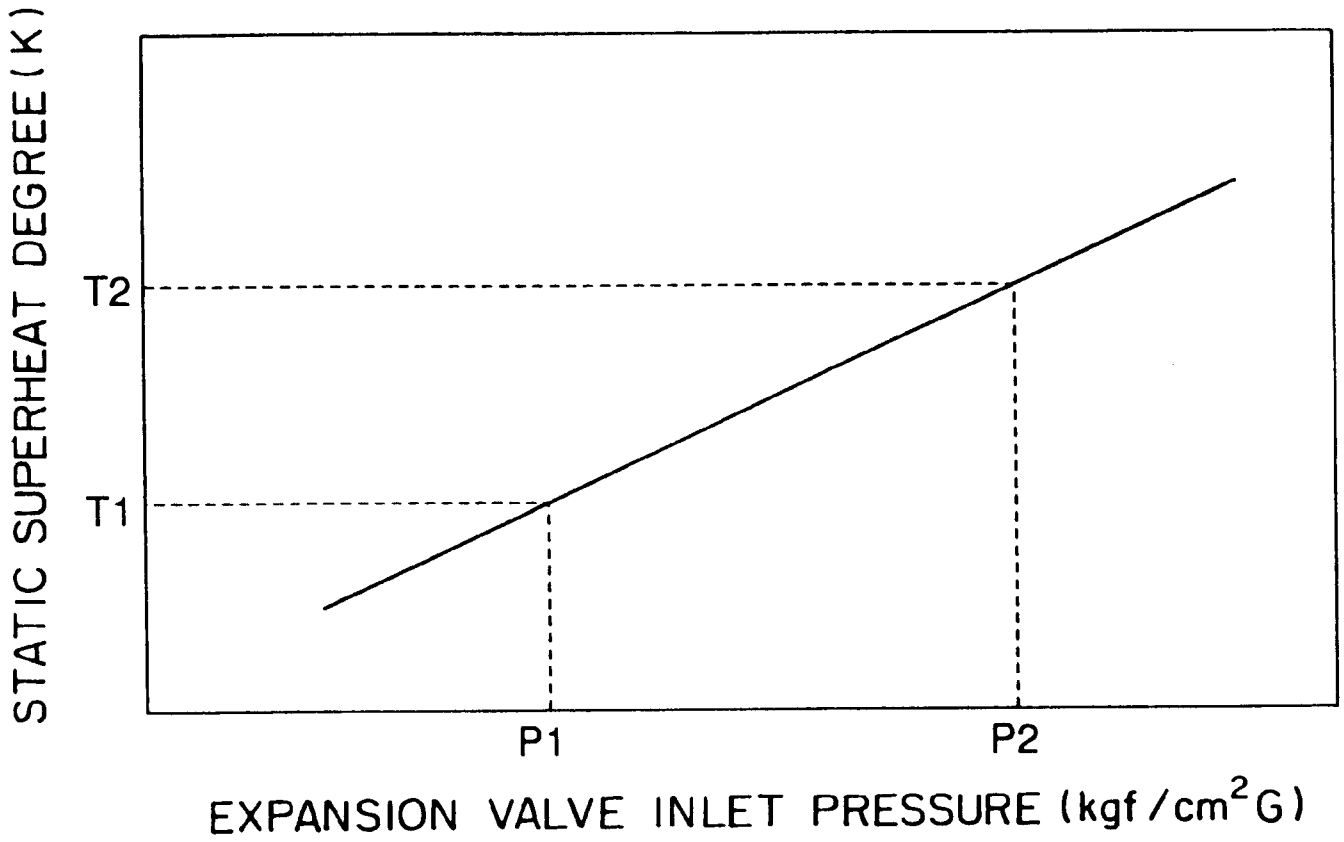
FIG. 6 is a diagram showing a characteristic of "an expansion valve inlet pressure—static superheat degree" under the condition that a temperature sensing portion of the thermostatic expansion valve shown in FIG. 4 is set to be constant.

With reference to FIG. 3, the description will be made as regards a thermostatic expansion valve according to a second embodiment of the present invention. The thermostatic expansion valve comprises similar parts designated by like reference numerals.

In the thermostatic expansion valve, the pressure transmission member 22 is movably supported by the adjustment screw 204 disposed in the pressure chamber 14 for the purpose of superheat adjustment. The valve body 201 is directly urged in the second direction by the spring 203 disposed in the high-pressure chamber 10, without using the aforementioned guide 202.

The thermostatic expansion valve of FIG. 3 provides the same operation as the previous embodiment. Therefore, a similarly desired superheat degree can be obtained without receiving an influence by a pressure of the expansion valve inlet.

While the present invention has thus far been described in connection with a few embodiments thereof, it will readily be possible for those skilled in the art to put this invention into practice in various other manners. For example, although the valve body is disposed or located in the high-pressure chamber in each of the first and the second embodiments, the valve body may be disposed in the low-pressure chamber.

What is claimed is:

1. A thermostatic expansion valve included in a refrigeration cycle for expansion of a refrigerant which is contained in said refrigeration cycle, said thermostatic expansion valve including a refrigerant passage for guiding said refrigerant, a valve mechanism placed in said refrigerant passage for adjusting a flow of said refrigerant in said refrigerant passage, and operation control means for controlling an operation of said valve mechanism in response to temperature of said refrigerant, said refrigerant passage having specific pressure when said refrigeration cycle is operated, said thermostatic expansion valve further comprising:

a particular chamber substantially separated from said refrigerant passage;

an additional passage connected between said particular chamber and said refrigerant passage for introducing said specific pressure into said particular chamber to make said particular chamber have particular pressure relating to said specific pressure; and a pressure transmission member coupled to said particular chamber and said valve mechanism for transmitting said particular pressure to said valve mechanism to reduce influence of said specific pressure to the operation of said valve mechanism.

2. A thermostatic expansion valve as claimed in claim 1, wherein said valve mechanism comprises:

a valve seat defining a part of said refrigerant passage; and a valve body facing said valve seat and movable in a first and a second direction which are opposite to each other, said valve body having a specific-pressure receiving area for receiving said specific pressure in said first direction, said pressure transmission member being coupled to said valve body and having a particular-pressure receiving area for receiving said particular pressure in said second direction.

3. A thermostatic expansion valve as claimed in claim 2, wherein said particular-pressure receiving area is determined substantially equal to said specific-pressure receiving area.

4. A thermostatic expansion valve as claimed in claim 2, wherein said particular-pressure receiving area is determined slightly smaller than said specific-pressure receiving area.

5. A thermostatic expansion valve as claimed in claim 2, wherein said specific-pressure receiving area is flat.

6. A thermostatic expansion valve as claimed in claim 1, wherein said refrigerant passage comprises a first and a second chamber which are connected to each other through said valve mechanism, said second chamber having, as said specific pressure, pressure lower than that of said first chamber when said refrigeration cycle is operated, said additional passage connecting said second chamber with said particular chamber.

7. A thermostatic expansion valve as claimed in claim 6, wherein said valve mechanism comprises:

a valve seat interposed between said first and said second chambers; and a valve body placed in said first chamber to face said valve seat and movable in a first and a second direction which are opposite to each other, said valve body having a specific-pressure receiving area for receiving said specific pressure through said valve seat in said first direction, said pressure transmission member being coupled to said valve body and having a particular-pressure receiving area for receiving said particular pressure in said second direction.

8. A thermostatic expansion valve as claimed in claim 7, wherein said particular-pressure receiving area is determined substantially equal to said specific-pressure receiving area.

9. A thermostatic expansion valve as claimed in claim 7, wherein said particular-pressure receiving area is determined slightly smaller than said specific-pressure receiving area.

10. A thermostatic expansion valve as claimed in claim 7, further comprising a valve casing, said valve body being movably supported by said valve casing.

11. A thermostatic expansion valve as claimed in claim 7, further comprising an adjustment screw for adjusting superheat degree of said refrigerant, said valve body being movably supported by said adjustment screw.

12. A thermostatic expansion valve as claimed in claim 7, wherein said specific-pressure receiving area is flat.

13. A thermostatic expansion valve as claimed in claim 7, further comprising a spring placed in said particular chamber for urging said pressure transmission member in said second direction.

14. A thermostatic expansion valve as claimed in claim 7, wherein said operation control means is coupled to said valve body and urges said valve body in said second direction in response to the temperature of said refrigerant.

15. A thermostatic expansion valve as claimed in claim 7, wherein said first chamber has inlet pressure when said refrigeration cycle is operated, said valve body having a first area for receiving said inlet pressure in said first direction and a second area for receiving said inlet pressure in said second direction, said first and said second areas being determined substantially equal to each other to cancel influence of said inlet pressure to said valve body between said first and said second directions.

* * * * *